United States Patent [19]

Cooper et al.

[11] Patent Number: 4,747,188

[45] Date of Patent: May 31, 1988

[54] WEB-LAYING

[75] Inventors: Roy Cooper, Bolton; Barrie Sedgely, Sandbach, both of England

[73] Assignee: Cosmopolitan Textile Company Limited, Cheshire, England

[21] Appl. No.: 105

[22] Filed: Jan. 2, 1987

[30] Foreign Application Priority Data

Jan. 15, 1986 [GB] United Kingdom ..... 8600901

[51] Int. Cl.[4] ..... D01H 5/38

[52] U.S. Cl. ..... 19/300; 19/302

[58] Field of Search ..... 19/296, 300, 302; 28/101, 102

[56] References Cited

U.S. PATENT DOCUMENTS

| | | | |
|---|---|---|---|
| 2,467,291 | 4/1949 | Brelsford et al. | 19/302 X |
| 3,903,569 | 9/1975 | Brandis | 19/163 |
| 4,406,389 | 9/1983 | Mowry, Jr. et al. | 226/29 |
| 4,574,433 | 3/1986 | Brunnschweiler | 19/300 X |

*Primary Examiner*—Louis K. Rimrodt

*Attorney, Agent, or Firm*—Oblon, Fisher, Spivak, McClelland & Maier

[57] ABSTRACT

A control system for a web-laying machine having reciprocating carriage means laying a web in folds on travelling conveyor means comprises variable speed drive means driving one of said carriage and conveyor means, conveyor measuring means measuring the travel of said conveyor means between reversals of direction of said carriage means, and control means controlling said drive means in accordance with the measured travel.

9 Claims, 1 Drawing Sheet

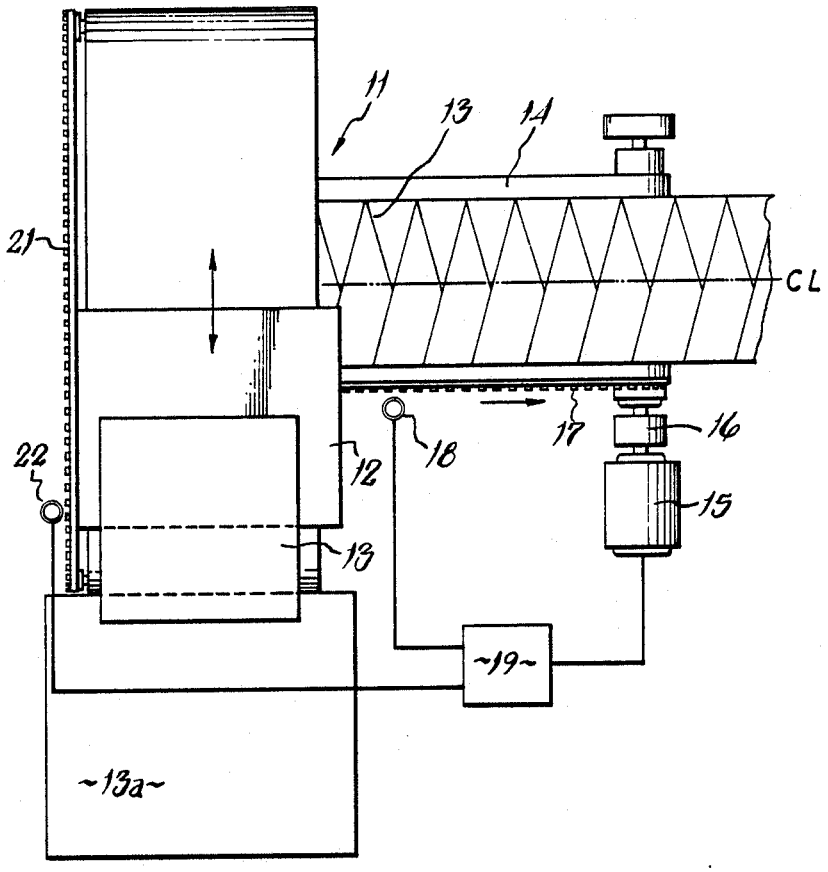
11
13
14
21
CL
22
12
18
17
16
15
13
19
13a

WEB-LAYING

BACKGROUND TO THE INVENTION

This invention relates to web-laying machinery such as cross-lapping or cross-folding machinery or parallel-laying machinery such as may be used in the textile, particularly the non-wovens, industry, to make a fleece out of a card web for example.

Such machinery comprises reciprocating carriage means which receive the card web on aprons and direct the end of the web on to conveyor means in such manner as to fold it on itself to build up a multi-layer fleece. A cross-lapper or cross-folder reciprocates the carriage means transversely to the direction of travel of the receiving conveyor means so that a ribbon of fleece is built up in which the fibres of a card web are substantially transversely aligned. A parallel-laying machine reciprocates the web parallel to the direction of travel of the receiving conveyor so that the card web fibres will lie parallel to the lengthwise direction of the ribbon of fleece so formed.

Web-laying machines are essentially solidly constructed mechanical devices, electrically driven, with considerable inertia in the reciprocating carriage means. While the operation of the machinery is usually as precise as may be expected from machinery of its size and weight, the effects of even small variations can often have a substantial effect upon the properties of the fleece produced thereby. For example, when the speed of operation is changing, as on start-up, the inertia of the carriage will give rise to a variation in the traverse width, because the mechanical interconnection between the carriage and the receiving conveyor, which determines the fleece width, the number of layers and other fleece characteristics, will react differently at different speeds. Other variations might appear as the result of voltage fluctuations, or the properties of resilient or pneumatic reversal-assisting buffers, or dimensional changes in aprons with age or ambient conditions, which might have the effect of producing a fleece which is too wide or too narrow or too heavy or too thick, or irregular in any of those regards.

The present invention provides a control system for a web-laying machine which overcomes these problems.

SUMMARY OF THE INVENTION

The invention comprises a control system for a web-laying machine having reciprocating carriage means laying a web in folds on travelling conveyor means, comprising variable speed drive means driving one of said carriage and conveyor means, conveyor measuring means measuring the travel of said conveyor means between reversals of direction of said carriage means, and control means controlling said drive means in accordance with the measured travel.

Said variable speed drive means may drive said conveyor means.

Said conveyor measuring means may comprise pulse generator means generating a pulse per unit distance travelled.

The control system may comprise correction means operative upon the measured travel between reversals being different from a predetermined travel to adjust the travel in a succeeding traverse compensatively. Said correction means may be operative to adjust the travel on the next succeeding traverse.

The control system may comprise carriage measuring means measuring the travel of said carriage between reversals. Said carriage measuring means may comprise pulse generating means generating a pulse per unit distance travelled.

Where the carriage (as is usual) has a variable traverse, the control system may comprise traverse control means operable to adjust the width and/or speed of traverse. Said traverse control means may be operable to adjust the positions of the ends of the traverse independently either side of a centreline of the said conveyor means.

BRIEF DESCRIPTION OF THE DRAWING

One embodiment of a control system according to the invention for a cross-folder will now be described with reference to the accompanying drawings, in which the single FIGURE is a diagrammatic representation of a carding machine and cross-folder together with a control system therefor.

DETAILED DESCRIPTION OF THE PREFERRED EMBODIMENTS

The FIGURE illustrates a control system for a web-laying machine, namely a cross-folder 11 having reciprocating carriage means 12 laying a web 13 from a card **13*a* in folds on travelling conveyor means 14. The control system comprises a variable speed motor 15 driving the conveyor means 14 through a transmission 16, conveyor measuring means comprising a timing belt 17 running with the conveyor means 14 generating pulses e.g. optically in a pulse generator 18 measuring the travel of the conveyor means 14 between reversals of direction of said carriage means 12, and control means 19 controlling said motor 15** in accordance with the measured travel.

Reversals of direction of the carriage means 12 are detected by an arrangement on the carriage 12 comprising another timing belt 21 and a stationary pulse generator 22 generating pulses e.g. optically from the timing belt 21 and being directional.

The control means 19 will be generally conventional in being operable to preset a motor 15 speed in a desired relation to the traverse rate of the cross-folder carriage 12 which in turn will be related to the rate of operation of the carding machine **13*a*. The conveyor measuring means 17, 18 will now measure the distance travelled by the conveyor means 14, however, between reversals of the carriage 12**.

The control means 19 is so organised as to calculate the distance travelled by the conveyor means 14 in between signals from the carriage measuring means 21, 22 indicating successive reversals of direction. The control means 19 will for example comprise a microprocessor or computer. The timing belt 17 may (as may the timing belt 21) have teeth at millimeter intervals so that the measurement is carried out to the nearest millimeter. If the pulse count indicates a conveyor means travel different from that preset, the control means 19 is programmed to alter the speed of the motor 15 for the next traverse compensatively, for example by such an amount as would be anticipated to make the conveyor means travel for the two traverses together equal to the preset distance for two traverses.

It could be arranged that it is not necessarily on the next succeeding traverse that the adjustment is effected—it may in some cases be desirable to delay an adjustment for example to give time for further measurement to be made or for a calculation to be effected. However, best results are achieved if the correction is made as soon as possible.

Having regard to what is said above, it will be seen that the carriage measuring means 21, 22 also permits irregularity of cross-folder operation or its departure for whatever reason from what is preset to be corrected. The carriage measuring means 21, 22 allow a measurement to be made, in similar fashion to the carriage measuring means, of carriage movement, so that the length of a traverse can be calculated.

This calculated traverse length can be related to the conveyor means travel between carriage 12 reversals in desired manner. For example, if fleece width is unimportant, but weight per unit area is important, the motor 15 can be controlled so as to maintain a constant relation between carriage 12 travel and conveyor 14 travel. If, on the other hand, fleece weight is unimportant, then the cross-folder drive (not specifically illustrated) can be operated by the control means 19 (or otherwise) so as to keep the web width constant, and indeed by specifying the reversal points in relation to a centreline C/L of the conveyor means 14 also to keep the fleece edges straight.

If fleece width and fleece weight are important, the control means 19 can be programmed to control both.

We claim:

1. A control system for a web-laying machine having reciprocating carriage means laying a web in folds on travelling conveyor means, comprising variable speed drive means driving one of said carriage and conveyor means, conveyor measuring means measuring the travel of said conveyor means between reversals of direction of said carriage means, and control means controlling said drive means in accordance with the measured travel.

2. A control system according to claim 1, in which said variable speed drive means drive said conveyor means.

3. A control system according to claim 1 or claim 2, in which said conveyor measuring means comprise pulse generator means generating a pulse per unit distance travelled.

4. A control system according to any claim 1 comprising correction means operative upon the measured travel between reversals being different from a predetermined travel to adjust the travel on a succeeding traverse compensatively.

5. A control system according to claim 4, said correction means being operative to adjust the travel on the next succeeding traverse.

6. A control system according to claim 1 comprising carriage measuring means measuring the travel of said carriage between reversals.

7. A control system according to claim 6, said carriage measuring means comprising pulse generator means generating a pulse per unit distance travelled.

8. A control system according to any claim 1 for a carriage having a variable traverse, comprising traverse control means operable to adjust the width and/or speed of traverse.

9. A control system according to claim 8, said traverse control means being operable to adjust the positions of the ends of the traverse independently either side of a centreline of the said conveyor means.

* * * * *